US009891018B2

(12) United States Patent
Dale et al.

(10) Patent No.: US 9,891,018 B2
(45) Date of Patent: Feb. 13, 2018

(54) MAGNETIC DEVICE FOR HOLDING A FIREARM

(71) Applicant: Pro Shooter Gear, Inc., Vista, CA (US)

(72) Inventors: Andrew Dale, Vista, CA (US); Dennis Gerasimenko, Vista, CA (US)

(73) Assignee: Pro Shooter Gear Inc., Vista, CA (US)

( * ) Notice: Subject to any disclaimer, the term of this patent is extended or adjusted under 35 U.S.C. 154(b) by 0 days.

(21) Appl. No.: 14/738,431

(22) Filed: Jun. 12, 2015

(65) Prior Publication Data

US 2015/0362280 A1 Dec. 17, 2015

Related U.S. Application Data

(60) Provisional application No. 62/012,097, filed on Jun. 13, 2014.

(51) Int. Cl.
*F41A 35/02* (2006.01)

(52) U.S. Cl.
CPC ..... *F41A 35/02* (2013.01)

(58) Field of Classification Search
CPC ..... F41A 35/02; F41C 33/06; F41B 5/1457
See application file for complete search history.

(56) References Cited

U.S. PATENT DOCUMENTS 2,639,751 A * 5/1953 Flaherty ..... B60J 11/00 114/361
2,872,960 A 2/1959 Kolpin
2,932,334 A * 4/1960 Steen ..... F41A 35/02 206/317
3,063,184 A * 11/1962 Sukala, Jr. ..... F41A 35/04 42/106
4,209,197 A * 6/1980 Fischer ..... B60J 11/00 150/166
4,257,464 A 3/1981 Binney
4,433,500 A 2/1984 Kunevicius
4,858,361 A 8/1989 White
5,025,843 A * 6/1991 Caufield ..... A63B 60/62 150/160
5,048,217 A 9/1991 Easter
5,778,590 A 7/1998 Browning et al.
(Continued)

OTHER PUBLICATIONS

International Search Report and Written Opinion issued in International Application No. PCT/US/2015/035690 dated Sep. 17, 2015.

*Primary Examiner* — Michael David
(74) *Attorney, Agent, or Firm* — Mintz Levin Cohn Ferris Glovsky and Popeo, P.C.

(57) ABSTRACT

A device that can hold a firearm can be used to prevent the firearm from being damaged, make the firearm aesthetically appealing, absorb the heat generated during use of the firearm, and reduce kick-back generated by the firearm. The device can include an inner portion, an outer portion, and magnets between the inner portion and the outer portion. The outer portion of the device can be made of a friction resistant material, which enhances durability to endure contact with items such as a gun rack or a stabilizing object. The inner portion of the device can be made of a soft material that can be used to cushion the firearm, and optionally clean the firearm. Related methods and products are also described.

17 Claims, 8 Drawing Sheets

(56) References Cited

U.S. PATENT DOCUMENTS

| | | | | |
|---|---|---|---|---|
| 6,119,388 | A * | 9/2000 | Jones | F41A 35/02 42/96 |
| 6,164,004 | A * | 12/2000 | Essary | F41A 35/02 42/96 |
| 6,256,922 | B1 | 7/2001 | Jones et al. | |
| 6,986,221 | B2 * | 1/2006 | Mullis | F41A 23/02 42/74 |
| 7,559,168 | B2 * | 7/2009 | Wisecup | F41G 1/383 150/154 |
| 7,954,526 | B2 * | 6/2011 | Chen | A63B 60/62 150/160 |
| 8,109,027 | B2 * | 2/2012 | Cragg | F41A 11/02 42/73 |
| 8,240,076 | B2 * | 8/2012 | Carley | F41G 1/383 206/317 |
| 8,307,577 | B2 * | 11/2012 | Baxter | F41A 35/02 206/317 |
| 8,347,539 | B2 * | 1/2013 | Burns, III | F41A 17/54 42/70.06 |
| 8,387,669 | B2 * | 3/2013 | Chen | A63B 60/62 150/160 |
| 8,490,788 | B2 * | 7/2013 | Perkins | F41B 5/1457 206/317 |
| 8,939,138 | B2 * | 1/2015 | Arajakis | F41C 23/02 124/87 |
| 9,360,273 | B1 * | 6/2016 | Steinbock | F41C 27/00 |
| 2012/0186737 | A1 | 7/2012 | Burdine et al. | |

* cited by examiner

MAGNETIC DEVICE FOR HOLDING A FIREARM

RELATED APPLICATION

This patent application claims priority to U.S. Provisional Patent Application Ser. No. 62/012,097, entitled "Device For Holding A Firearm" and filed on Jun. 13, 2014, the contents of which are incorporated herein by reference in entirety.

FIELD

The subject matter described herein relates to a device that holds a firearm in order to prevent damaging the firearm, while still making the firearm be aesthetically appealing, absorb heat generated during a use of the firearm, and reduce kick-back generated by the firearm during use of the firearm.

BACKGROUND

Firearms are tools that need to be stored so that they are accessible when needed, but without allowing damage to occur to the firearm. Additionally, when in use, it is desirable to have a way of protecting the firearm from damage, such as from friction caused by contact with a stabilizing object, as well as protecting the user from vibration, heat, or other types of irritation caused by the firearm during use.

SUMMARY

Methods and apparatus are provided for holding a firearm in a manner that insulates a portion of the firearm from its surroundings to prevent the firearm from being damaged, while still making the firearm be aesthetically appealing, absorb heat generated during use of the firearm, and reduce kick-back generated by the firearm during use of the firearm. The apparatus includes an outer portion, an inner portion, and magnets between the outer portion and the inner portion so that the apparatus can hold itself in place on the barrel of a firearm. The apparatus can optionally include a padding layer between the outer portion and the inner portion. The outer portion of the apparatus can be durable and friction resistant. The inner portion of the apparatus can be soft, as well as capable of being used to clean the firearm of debris, gunpowder, dirt, and the like.

Methods described herein include using the apparatus to store a firearm while protecting the firearm from its surroundings. Methods presented herein can also include using the apparatus to protect the firearm from scratches caused by using the firearm with a support object, such as a stabilizing block. Additionally, or alternatively, the methods can include using the apparatus to clean the outside of the firearm, such as to wipe off lead, gunpowder and its residue, other dirt, or any combination thereof. The methods can also include using the apparatus to mitigate vibration, force, or heat transfer between the firearm and a user, such as when discharging (e.g., firing) the firearm.

In one aspect, an apparatus is described that can include an outer portion, an inner portion, and at least two magnets between the outer portion and the inner portion. The at least two magnets can hold the outer portion and the inner portion in place on a barrel of a firearm.

In some variations, one or more of the following can additionally be implemented either individually or in any feasible or suitable combination. The apparatus can further include a padding layer between the outer portion and the inner portion. The outer portion can be configured to resist friction. The outer portion can be made of one or more of: leather, polyurethane, imitation leather, regenerated leather, bonded leather, canvas, coated canvas, suede, heavy cloth, reptile skin, and sheepskin. The inner portion can be configured to be soft. The inner portion can be made of one or more of: cloth, felt, padding, plush material, synthetic material, artificial fur, animal fur, sheepskin, and silk. The inner portion can be configured to be used to clean at least one of debris, gunpowder, and dirt on the barrel of the firearm.

The apparatus can further include a centerline. The centerline can be aligned with the barrel of the firearm when the firearm is in use and with at least one magnet on each side centerline of the apparatus. The at least two magnets can be made of a same material and have a same shape. A shape of each of the outer portion and the inner portion can be one of elliptical, oval, and circular. A diameter of each of the outer portion and the inner portion can allow each of the outer portion and the inner portion to cover more than half of the barrel of the firearm. In one implementation, the diameter can be 6 inches or more than 6 inches. In another implementation, the diameter can be 6.75 inches or more than 6.75 inches.

In another aspect, an apparatus can be applied to a barrel of a firearm. The apparatus can include an outer portion, an inner portion, and at least two magnets between the outer and inner portions. The at least two magnets can be configured to hold the outer portion and the inner portion in place on the barrel of the firearm. The firearm with the applied apparatus can be stored in a gun rack.

In some variations, one or more of the following can additionally be implemented either individually or in any feasible or suitable combination. The gun rack can include one or more depressions configured to store the firearm. The apparatus can further include a padding layer between the outer portion and the inner portion.

In yet another aspect, an apparatus can be applied to a barrel of a firearm. The apparatus can include an outer portion, an inner portion, and at least two magnets between the outer and inner portions. The at least two magnets can be configured to hold the outer portion and the inner portion in place on the barrel of the firearm. The firearm with the applied apparatus can be placed on a support object.

In some variations, one or more of the following can additionally be implemented either individually or in any feasible or suitable combination. The firearm can be placed on the support object by overlaying the applied apparatus on the support object. The applied apparatus can minimize transfer of vibration, force, and heat generated, when the firearm is discharged, to a user discharging the firearm. The apparatus can further include a padding layer between the outer portion and the inner portion.

The above-noted aspects and features may be implemented in systems, apparatuses, methods, and/or articles depending on the desired configuration. The details of one or more variations of the subject matter described herein are set forth in the accompanying drawings and the description below. Features and advantages of the subject matter described herein will be apparent from the description and drawings, and from the claims.

Figure 1:
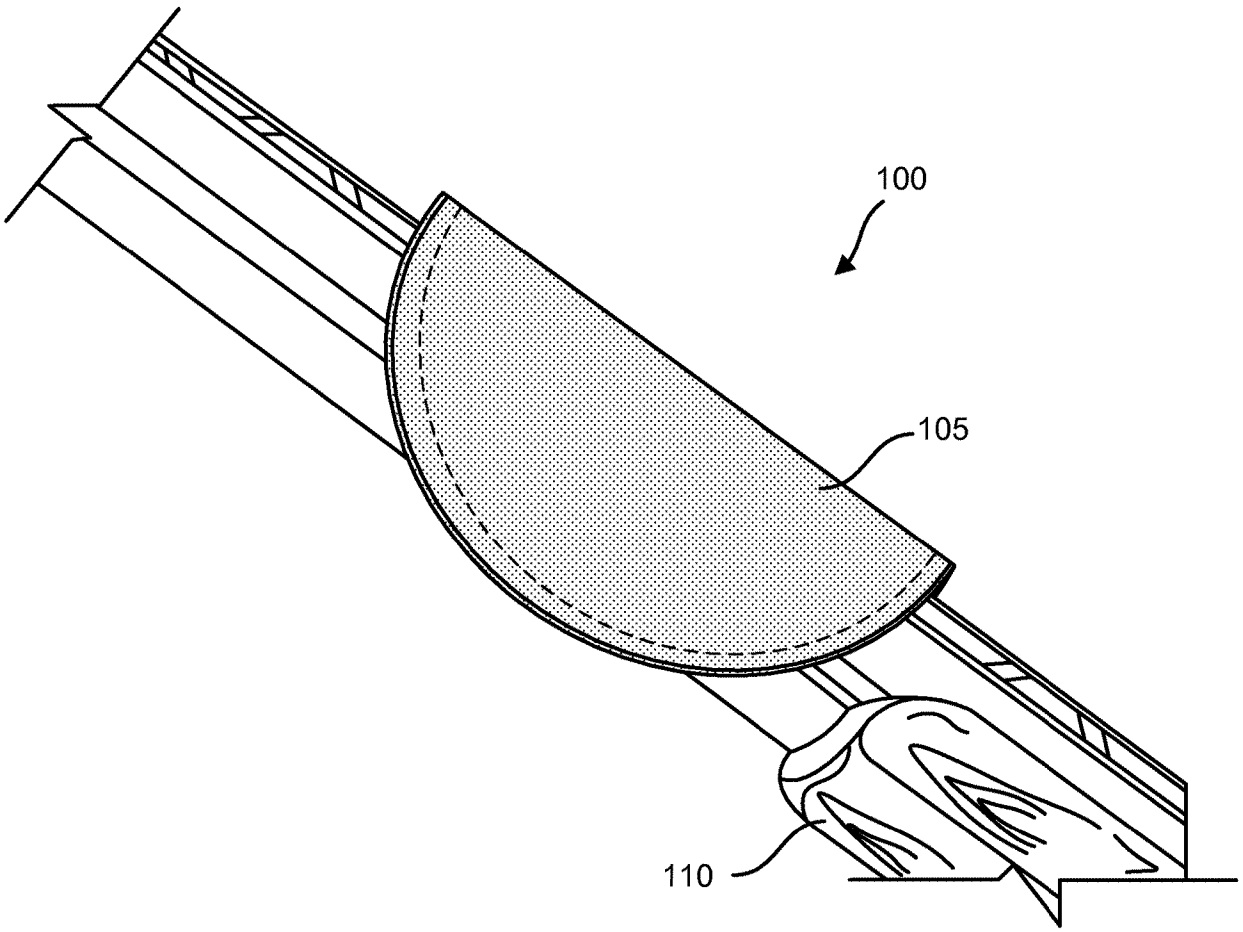
FIG. 1 shows an example of a device for holding a firearm placed around a barrel of a firearm.

Like labels are used to refer to the same or similar items in the drawings.

DETAILED DESCRIPTION

FIG. 1 shows one view of an exemplary implementation 100 of a device 105 for holding a firearm 110 in use around a barrel of firearm 110, which is shown as a rifle. The device 105 is shown about the barrel of the firearm 110, adjacent to the forestock of the firearm. A pair of magnets hold the device to the barrel of the firearm 110.

The device 105 can enable maintenance of the firearm 110 in a good condition, both during storage of the firearm 110 and usage of the firearm 110. The device 105 can protect the firearm 110 when the firearm 110 is being stored in, for example, a gun rack. The device 105 can also protect the firearm 110 when the firearm 110 is in contact with a supporting object (or a supporting substance) or any other object (or substance) that can cause scratches or other marks due to friction between the firearm and its surroundings. The device 105 can also be used to prevent the transfer of force, such as kickback or friction, or temperature, including heat, from the firearm 110 to the user so that discharging (e.g., firing) the firearm is more comfortable. The device 110 can also make the firearm 110 aesthetically appealing (for example, aesthetically pleasing).

As discussed above, the firearm 110 shown in FIG. 1 is a rifle. This rifle can be one or more of air gun, an automatic rifle, a bolt action, a double rifle, a lever-action rifle, a recoilless rifle, a repeating rifle, a revolving rifle, a semi-automatic rifle, a short-barreled rifle, a spencer rifle, and the like. Although the firearm 110 is described as a rifle, in other implementations, the firearm 110 can be any one of a handgun, a shotgun, a musket, a carbine, and the like.

Figure 2:
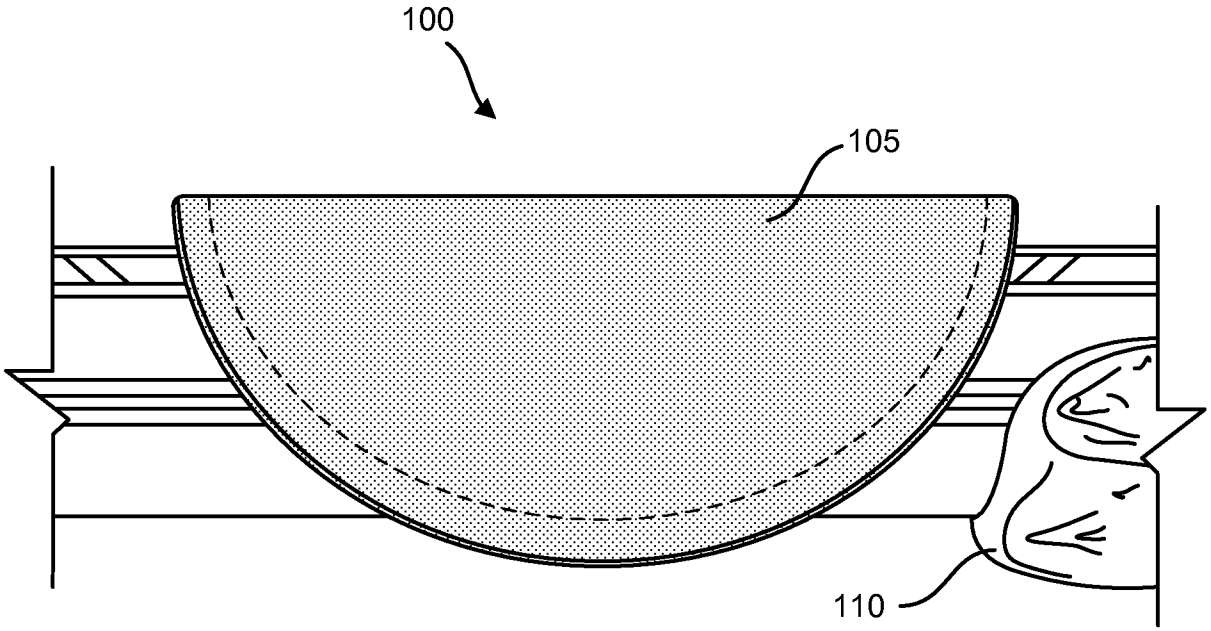
FIG. 2 shows another view of the example of the device for holding a firearm placed around the barrel of the firearm.

FIG. 2 shows another view of the implementation 100 of a device 105 for holding a firearm 110 in use around the barrel of a firearm 110.

Figure 3:
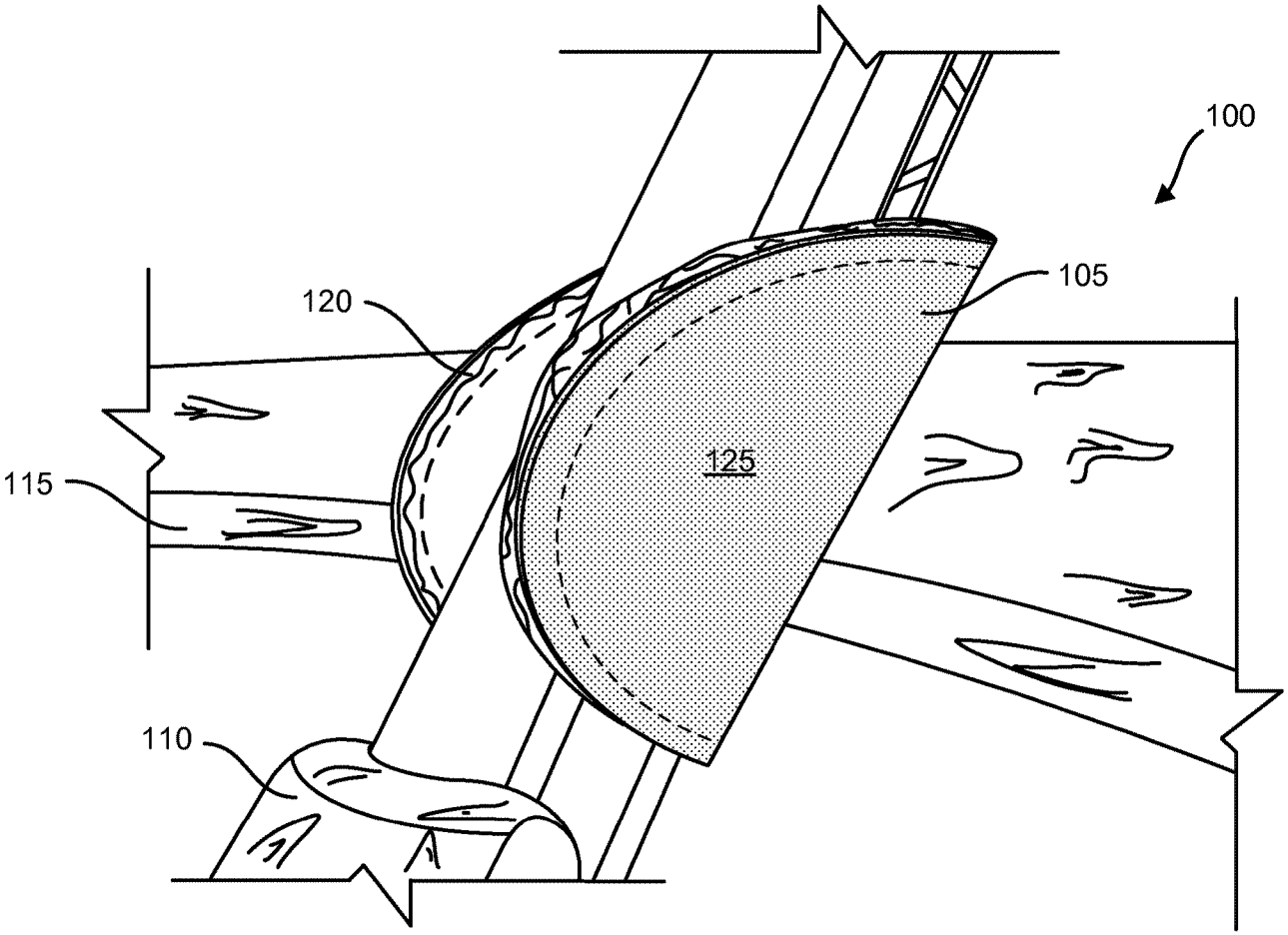
FIG. 3 shows another view of the example of the device for holding a firearm in use.

FIG. 3 shows the exemplary implementation 100 of the device 105 for holding a firearm in a use configuration. The device 105 is wrapped around the barrel of the firearm 110, as also shown in FIGS. 1 and 2. The inner 120 and outer 125 portions of the device 105 can be seen. The outer portion 125 of the device is in contact with the surroundings of the firearm 110. In FIG. 3, the firearm 110 is shown leaning on the edge of a stabilizing object 115. The outer portion 125 of the device 105 can contact the edge of the stabilizing object 115 while the inner portion 120 contacts the barrel of the firearm 110.

Figure 4:
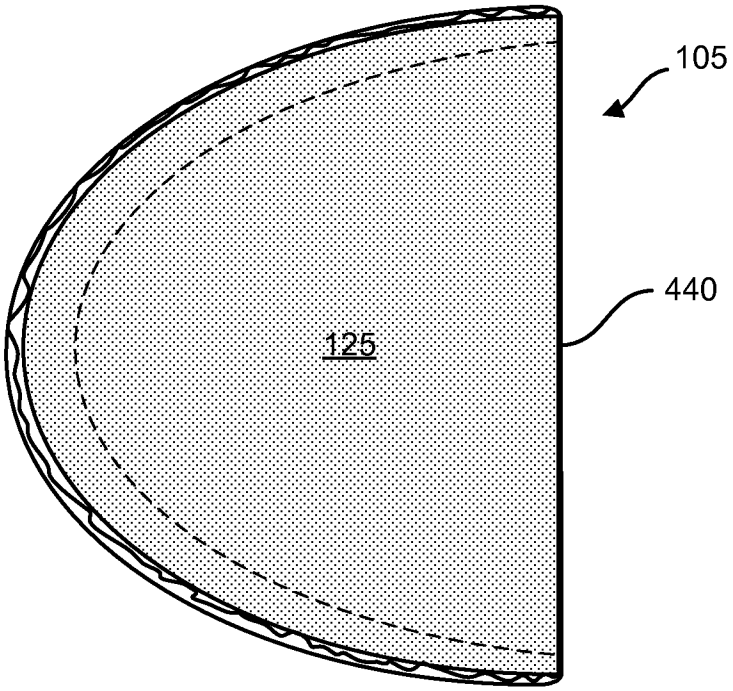
FIG. 4 shows an exemplary device for holding a firearm without the firearm in a closed configuration.

FIG. 4 shows an implementation of a device 105 for holding the firearm 110. The outside portion 125 of the device 105 is shown, and the device 105 is shown folded along a centerline 440. The material forming the outside portion 125 can be any suitably durable material, such as one or more of: leather, polyurethane (for example, imitation leather), regenerated leather (for example, bonded leather), canvas, coated canvas, suede, heavy cloth, reptile skin (for example, alligator, snake), sheepskin, and the like. The material forming the outside portion 125 can be suitable for use with a wide temperature range such as −40° C. to +50° C. or more. The material forming the outside portion 125 can also withstand repeated folding, particularly along the centerline 440 of the device. Water and stain resistance can also be characteristics of the material forming the outside portion 125 of the device 105. In addition, the material forming the outside portion 125 can be suitable for easy cleaning such as in a washing machine.

Figure 5:
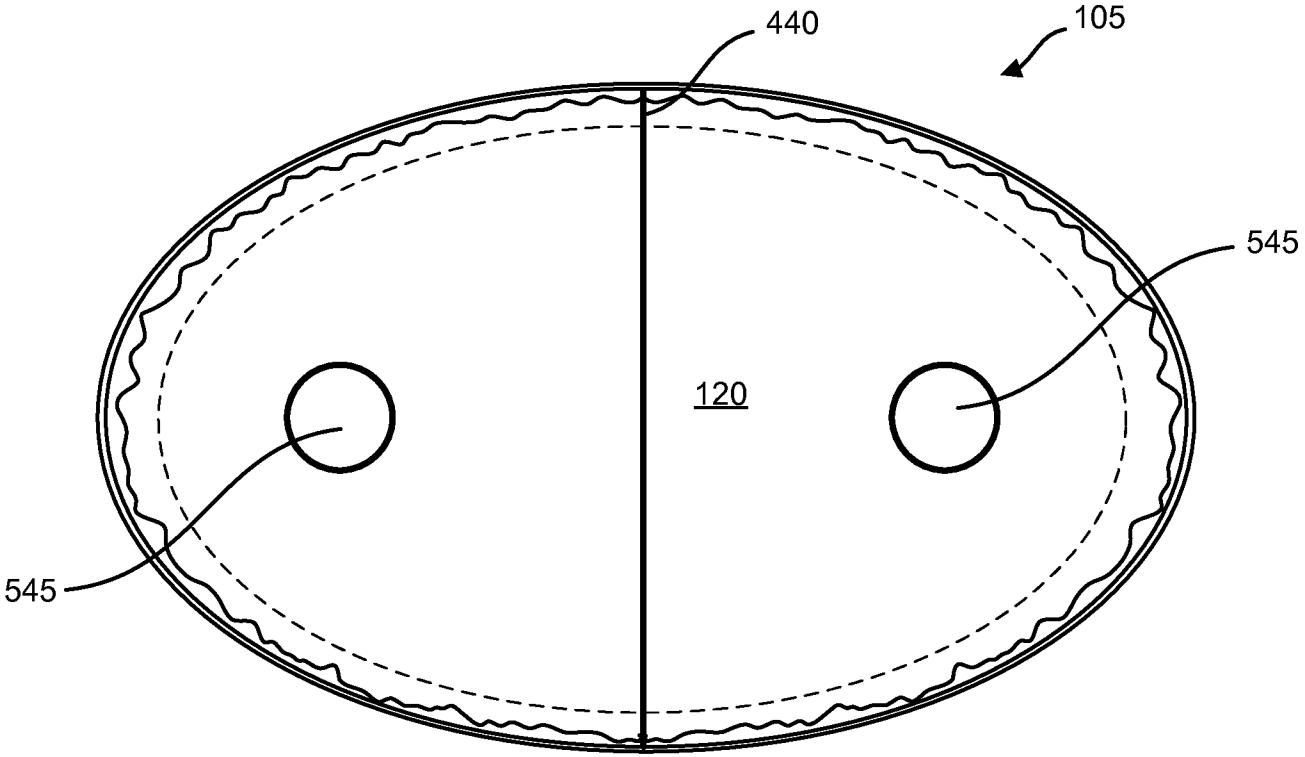
FIG. 5 shows an exemplary device for holding a firearm without the firearm in an open configuration, showing the soft interior of the exemplary device.

FIG. 5 shows an implementation of an open configuration of the device 105 for holding a firearm 110. The inner portion 120 of the device is shown, and the centerline 440 is identified for easier orientation within the figure. On either side of the centerline 440, there is a magnet 545 (represented by circles in FIG. 5 and FIG. 6) underneath the material of the inner portion 120. The material of the inner portion 120 can be any suitably soft, easily cleaned material. Some examples of materials for the inner portion 120 of the device 105 include one or more of: cloth, felt, padding, plush material, a synthetic material, artificial fur, animal fur, sheepskin, silk, and the like. Padding material, such as wool, cotton, or synthetic fibers, can be inserted between the inner portion 120 and the outer portion 125 of the device 105. The material used for the inner portion 120 of the device, alone or in combination with the material of the outside of the device, as well as the padding material, can fold easily, such as along the centerline 440. In addition, the material forming the inner portion 120 can be suitable for easy cleaning such as in a washing machine.

The material used for the inner portion 120 can also be used to clean lead, gunpowder, dirt, and the like, from the outside of the firearm 110. Additionally, the device 105 can be cleaned easily, such as by washing with water, including hand washing or machine washing.

The magnets 545 can both be of the same material, or each can be of a different material. In some exemplary implementations, one or both of the magnets 545 can be rare-earth magnets or magnets of another ferromagnetic material. The magnets 545 can be any suitable size and shape, such as disk-shaped and approximately 1.5 cm in diameter. The magnets 545 can be held in place in the device 105 with, for example, stitching or adhesive. The location of the magnets 545 can be any location that is convenient for holding the device 105 in place against the barrel of a firearm, such as a set distance away from the centerline 440 or a set distance away from the edge of the device.

Figure 6:
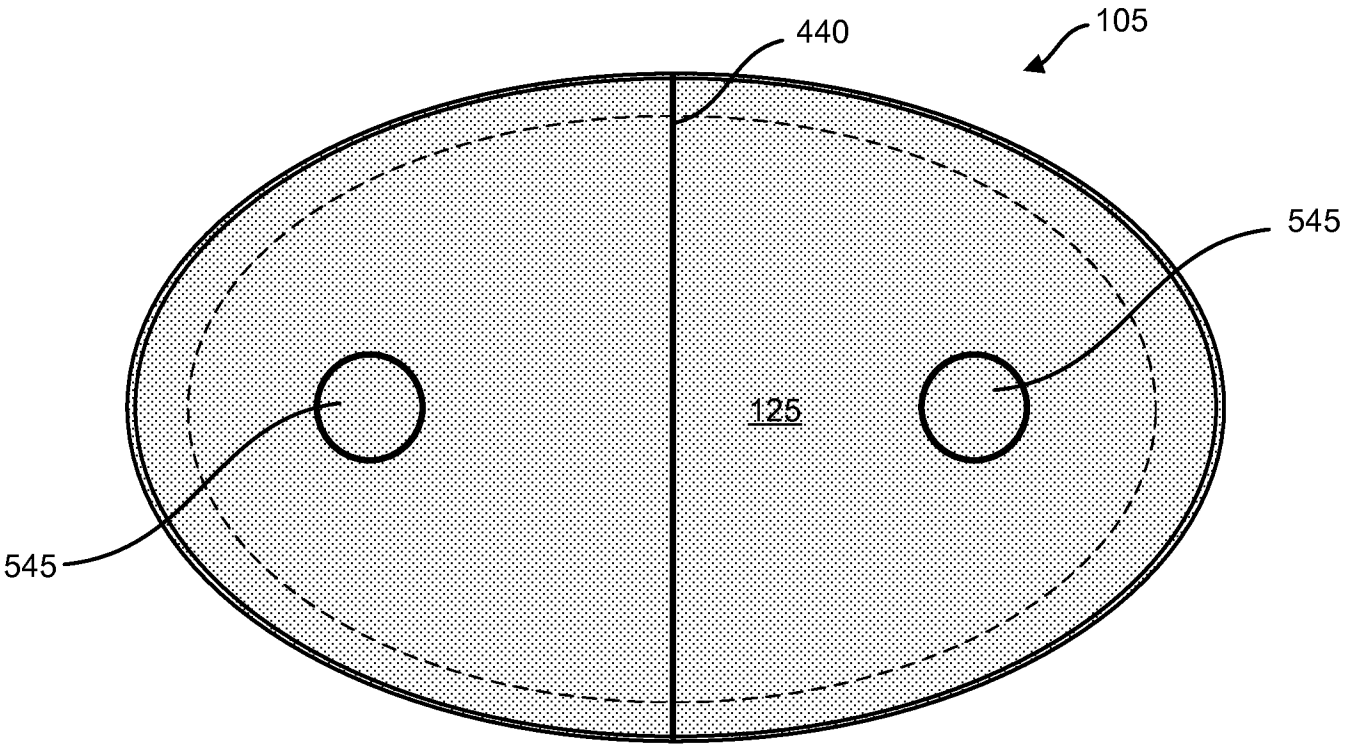
FIG. 6 shows an exemplary device for holding a firearm without the firearm in an open configuration, showing the durable exterior of the exemplary device.
Figure 7B:
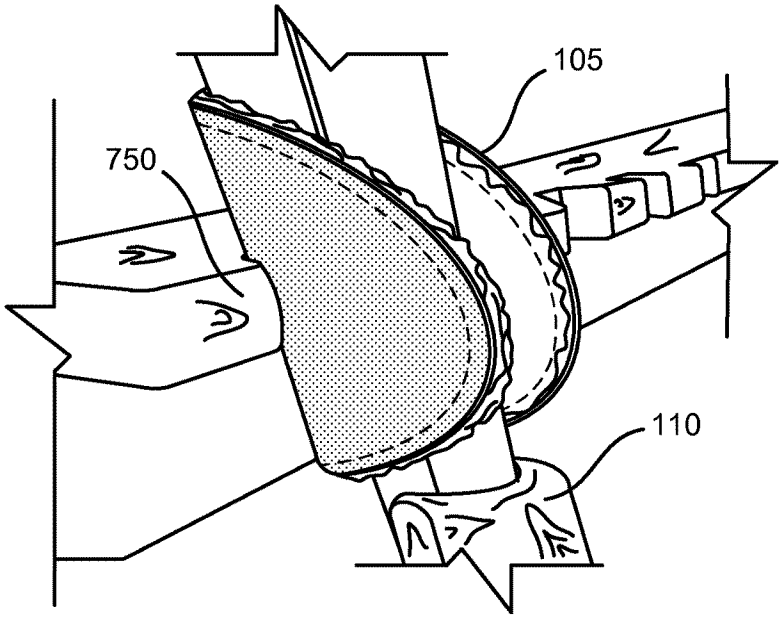
FIGS. 7A, 7B, 8A, and 8B show an exemplary device for holding a firearm in a rack.
Figure 7A:
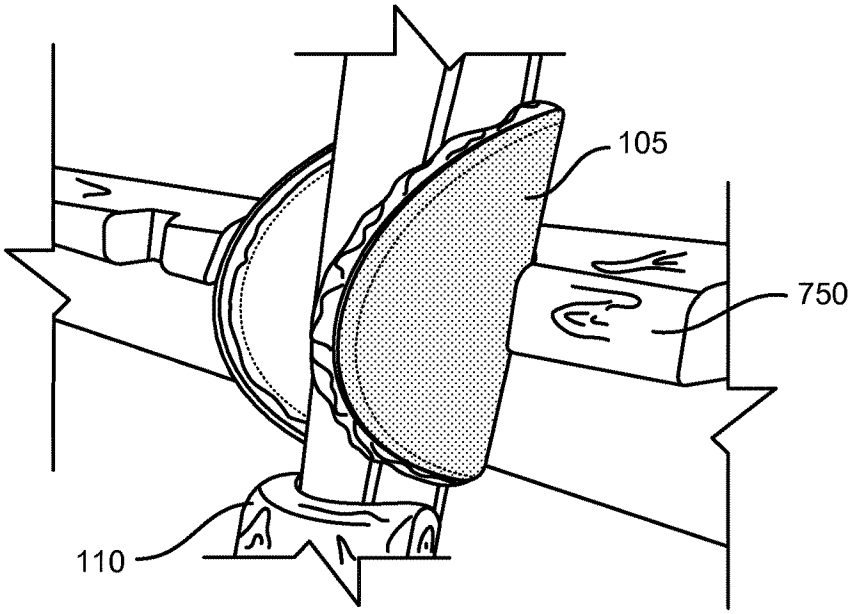
Figure 8B:
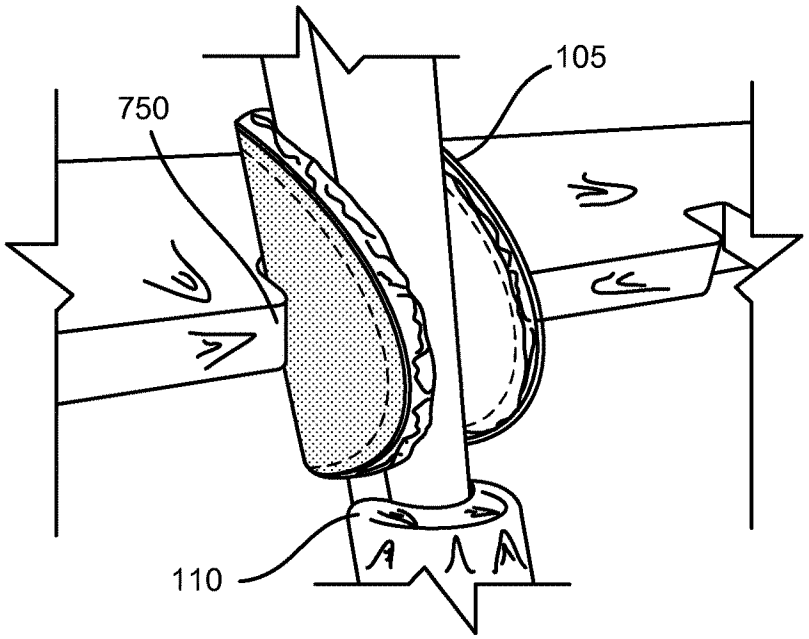
Figure 8A:
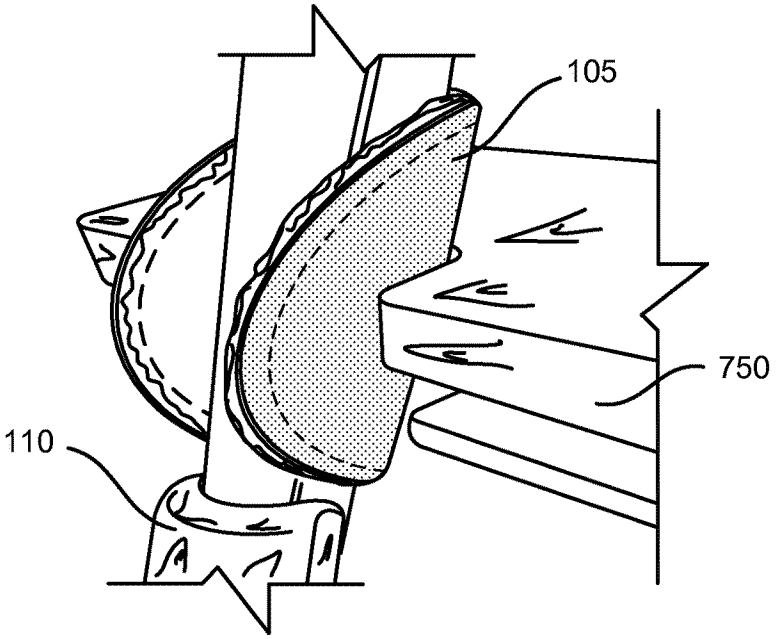

FIG. 6 shows implementation of a device 105 for holding a firearm 110 in an open configuration. Two magnets 545 can be placed in the device 105, one on either side of the centerline 440. The outer portion 125 is shown in FIG. 6.

From FIGS. 5 and 6, the overall shape of the device 105 can be seen. The device 105 can be elliptical or oval shaped. Alternatively, the device 105 can be circular, such as disk shaped. Other shapes of the device 105 are also possible, such as a square, a rectangle, a pentagon, a hexagon, any polygon, any irregular shape, of the like. The device 105 can have a diameter that allows the device 105 to cover much of the barrel of an average gun or rifle, such as about 6.25 inches (15.875 cm.), including about 6 inches (15.24 cm), about 6.5 inches (16.51 cm), and about 6.75 inches (17.145 cm). In some embodiments, the device 105 can have a diameter ranging from about 6 inches to about 6.75 inches. The centerline 440 is along the minor axis of the oval or along the diameter of the circle, and the magnets 545 are shown to be a predetermined distance away from the edge of the device 105, as measured at the major axis of the device 105 in the case of an oval shaped device. In some embodiments, the magnets 545 can be 0.75 inches (1.905 cm) away from the edge of the device 105. As indicated above, the device 105 can have two layers (for example, the outer portion and the inner portion) or three layers (for example, the outer portion, the inner portion, and a padding layer between the outer portion and the inner portion).

Both the outer portion 125 and inner portion 120 materials can be any pattern or color, such as a solid color, camouflage, animal print, striped, checked, paisley, argyle, plaid, or any combination thereof.

FIGS. 7A, 7B, 8A, and 8B show a firearm 110 with a device 105 in use in a rack 750. The rack 750 can have one or more depressions, each of which is sized to accommodate a firearm 110 by, for example, supporting the barrel of a firearm 110 while one end of the firearm 110 rests on a base of the rack 750 or on the ground. The device 105 is shown fitting around the barrel of the firearm 110, between the firearm 110 and the rack 750. When used in this way, the device 105 can prevent scratches from appearing on the firearm 105 when the firearm 110 is placed in and removed from the rack 750. Also, a firearm 105 that may be elevated in temperature can be placed into the rack 750 without concern that heat from the firearm could cause an adverse interaction between the firearm 110 and the rack 750, more specifically between the barrel of the firearm 110 and the paint on the rack 750.

Although the device 105 is described as including one or more magnets to hold the firearm 110, in other implementations, the device 105 can include any suitable mechanism to allow for reversible attachment of the device 105 to the firearm 110. Some examples of such suitable mechanisms can include one or more of: straps with hook and loop closures (for example, Velcro®), grommets and laces, ties, snaps, buttons, buckles, hooks, adhesive, tape, bands (for example, rubber bands, metal bands), and the like.

Although a few variations have been described in detail above, other modifications or additions are possible. In particular, further features and/or variations may be provided in addition to those set forth herein. For example, the implementations described above may be directed to various combinations and subcombinations of the disclosed features and/or combinations and subcombinations of several further features disclosed above. In addition, the logic flow depicted in the accompanying figures and/or described herein does not require the particular order shown, or sequential order, to achieve desirable results. The phrases "based on" and "based on at least" are used interchangeably herein. Other implementations may be within the scope of the following claims.

What is claimed is:

1. An apparatus consisting of:

an outer layer made of one or more of: leather, polyurethane, imitation leather, regenerated leather, bonded leather, canvas, coated canvas, suede, heavy cloth, reptile skin, and sheepskin, the outer layer having one of elliptical, oval, and circular shapes;

an inner layer made of one or more of: cloth, felt, padding, plush material, synthetic material, artificial fur, animal fur, sheepskin, and silk, the inner layer having one of elliptical, oval, and circular shapes, a diameter of each of the outer layer and the inner layer allowing each of the outer layer and the inner layer to cover more than half of the barrel of the firearm, the diameter being between 6 inches and 10 inches;

at least two magnets between the outer layer and the inner layer, the at least two magnets configured to hold the outer layer and the inner layer in place on a barrel of a firearm when the firearm is being used for firing, the inner layer and the outer layer in their entireties being in front of a trigger of the firearm in a direction along a length of the firearm; and a centerline, the centerline being aligned with the barrel of the firearm when the firearm is in use and with at least one magnet on each side of the centerline.

2. The apparatus of claim 1, wherein the at least two magnets have a same shape.

3. The apparatus of claim 1, wherein:

the outer layer has the circular shape; and a diameter of the outer layer allows the outer layer to cover more than a quarter of the barrel of the firearm.

4. The apparatus of claim 3, wherein the diameter is 6 inches or more than 6 inches.

5. The apparatus of claim 1, wherein:

the inner layer has the circular shape; and a diameter of the inner layer allows the inner layer to cover more than a quarter of the barrel of the firearm.

6. The apparatus of claim 5, wherein the diameter is 6 inches or more than 6 inches.

7. The apparatus of claim 1, wherein at least one of the inner layer and the outer layer is configured to absorb heat when the firearm is used for firing.

8. The apparatus of claim 1, wherein at least one of the inner layer and the outer layer is configured to mitigate kickback when the firearm is used for firing.

9. The apparatus of claim 1, wherein the firearm is a rifle.

10. The apparatus of claim 9, wherein the rifle is one of an air gun, an automatic rifle, a bolt action, a double rifle, a lever-action rifle, a recoilless rifle, a repeating rifle, a revolving rifle, a semi-automatic rifle, a short-barreled rifle, and a spencer rifle.

11. The apparatus of claim 1, wherein the firearm is one of a handgun, a shotgun, a musket, and a carbine.

12. The apparatus of claim 1, wherein the outer layer is configured to be used between −40 degrees Celsius and +50 degrees Celsius.

13. The apparatus of claim 1, wherein the outer layer is resistant to at least one of water and stains.

14. The apparatus of claim 1, wherein:

each of the outer layer and the inner layer have the circular shape; and a diameter of each of the outer layer and the inner layer allows each of the outer layer and the inner layer to cover more than half of the barrel of the firearm.

15. The apparatus of claim 14, wherein the diameter is 6 inches or more than 6 inches.

16. The apparatus of claim 14, wherein the diameter is 6.75 inches or more than 6.75 inches.

17. The apparatus of claim 1, wherein the at least two magnets are made of a same material.

* * * * *